US008656515B2

(12) United States Patent
Newton et al.

(10) Patent No.: US 8,656,515 B2
(45) Date of Patent: Feb. 25, 2014

(54) PERFORMANCE APPAREL WITH FLEXIBLE PORTION

(75) Inventors: Anna E. Newton, Roslindale, MA (US); Hongqing Shen, Weymouth, MA (US); Hsin Min Chung, Hong Kong (CN); Ricardo Vestuti, Providence, RI (US); William Marvin, Canton, MA (US); David J. Lacorazza, Norwell, MA (US)

(73) Assignee: Reebok International Limited, London (GB)

( * ) Notice: Subject to any disclaimer, the term of this patent is extended or adjusted under 35 U.S.C. 154(b) by 417 days.

(21) Appl. No.: 13/004,551

(22) Filed: Jan. 11, 2011

(65) Prior Publication Data

US 2012/0174282 A1 Jul. 12, 2012

(51) Int. Cl.
*A41D 13/00* (2006.01)

(52) U.S. Cl.
USPC ..... 2/69

(58) Field of Classification Search
USPC ..... 2/69, 79, 227, 44, 92, 83, 115, 310; 482/105
See application file for complete search history.

(56) References Cited

U.S. PATENT DOCUMENTS 5,367,708 A * 11/1994 Fujimoto ..... 2/22
6,047,406 A 4/2000 Dicker et al.
7,168,104 B2 * 1/2007 Tobergte ..... 2/459
7,516,498 B2 * 4/2009 Torry ..... 2/69
7,992,223 B2 * 8/2011 Manzo ..... 2/171
2004/0107479 A1 6/2004 Dicker et al.
2004/0255358 A1 12/2004 Ota et al.
2007/0074328 A1 4/2007 Melhart et al.
2008/0295230 A1 12/2008 Wright et al.

FOREIGN PATENT DOCUMENTS

EP 1752054 A1 2/2007
EP 1980165 A1 10/2008

OTHER PUBLICATIONS

International Search Report for International Application No. PCT/US2011/029768, dated May 20, 2011, 2 pages.
Written Opinion for International Application No. PCT/US2011/029768, dated May 20, 2011, 7 pages.

* cited by examiner

*Primary Examiner* — Tejash Patel
(74) *Attorney, Agent, or Firm* — Sterne, Kessler, Goldstein & Fox P.L.L.C.

(57) ABSTRACT

Athletic garments are disclosed. The garment may comprise: a base layer having a front surface and a back surface; a first flexible layer disposed on the front surface and the back surface of the base layer, the first flexible layer having a plurality of voids forming a first lattice pattern; and a second flexible layer disposed on the front surface and the back surface of the base layer, the second flexible layer having a plurality of voids forming a second lattice pattern.

29 Claims, 20 Drawing Sheets

PERFORMANCE APPAREL WITH FLEXIBLE PORTION

BACKGROUND OF THE INVENTION

1. Field of the Invention

The present invention is directed to apparel, and, in particular, performance apparel.

2. Background Art

Physical activity is important to maintaining a healthy lifestyle and individual well-being. There are many activities in daily life that require individuals to use their strength, agility, posture and balance, and maintaining physical fitness can help individuals complete these activities with minimum disruption to their lives. Maintaining physical fitness has also been shown to strengthen the heart, boost HDL cholesterol, aid the circulatory system, and lower blood pressure and blood fats, translating to lower risk for heart disease, heart attack, and stroke. Physical activity also strengthens muscles, increases flexibility, and promotes stronger bones, which can help prevent osteoporosis.

Garments worn during physical activities should not hinder the wearer's performance of their activity, and should ideally support the user in achieving their physical fitness goals. Garments are known that purport to assist a user in achieving a variety of fitness goals, including increasing muscle activation in desired locations. However, existing garments often suffer from myriad problems such as poor functionality, uncomfortable fit, high cost, and undesirable aesthetics.

Accordingly, there is a need for garments with improved functionalities that may solve one or more of the above mentioned problems with existing garments. There is also a need for garments that allow a wearer to better achieve his or her physical fitness goals while engaging in physical activity throughout the course of his or her daily routine.

BRIEF SUMMARY OF THE INVENTION

Embodiments of the present invention relate to an athletic garment. The garment may comprise a base layer having a front surface and a back surface; a first flexible layer disposed on the front surface and the back surface of the base layer, the first flexible layer having a plurality of voids forming a first pattern; and a second flexible layer disposed on the front surface and the back surface of the base layer, the second flexible layer having a plurality of voids forming a second pattern. In one embodiment, the first pattern and/or the second pattern may be a lattice pattern.

In one embodiment, an athletic garment may comprise: a base layer; and a continuous flexible and elastic layer disposed on a portion of the base layer, the flexible and elastic layer having a plurality of voids therein forming a honeycomb pattern.

In another embodiment, an athletic garment may comprise: a base layer comprising a shirt having a front surface, a back surface, and first and second shoulder portions; a continuous first flexible layer disposed on the front surface and the back surface of the base layer, the first flexible layer having upper and lower transition portions extending between the front surface and the back surface, the first flexible layer defining a void of the first flexible layer over the first shoulder portion of the base layer and having a plurality of smaller voids forming a pattern; and a continuous second flexible layer discrete from the first flexible layer disposed on the front surface and the back surface of the base layer, the second flexible layer having upper and lower transition portions extending between the front surface and the back surface, the second flexible layer defining a void of the second flexible layer over the second shoulder portion of the base layer and having a plurality of smaller voids forming a pattern. The upper transition portion may extend over a portion of the trapezius muscle group of the wearer. The lower transition portion may extend over a portion of the latissimus dorsi muscle group of the wearer.

In another embodiment, a garment comprises: a base layer; and a flexible layer comprising silicon ink printed on the base layer, the flexible layer having a plurality of voids forming a honeycomb pattern.

In yet another embodiment, an athletic garment comprises: a base layer; and a continuous flexible and elastic layer having a plurality of voids forming a lattice pattern disposed on a portion of the base layer, wherein the portion of the base layer with the continuous flexible and elastic layer disposed thereon together have a stretch in the range of about 15% to about 20% and a modulus of about 10.7 N to about 13.3 N at 40% elongation.

BRIEF DESCRIPTION OF THE DRAWINGS

The accompanying drawings, which are incorporated herein and form a part of the specification, illustrate the present invention and, together with the description, further serve to explain the principles of the invention and to enable a person skilled in the pertinent art to make and use the invention.

DETAILED DESCRIPTION OF THE INVENTION

Figure 1:
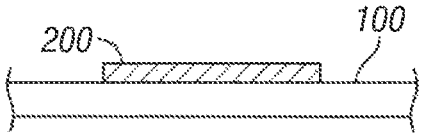
FIG. 1 is a schematic representation of a flexible layer on a base layer according to an embodiment of the present invention.

The present invention will now be described in detail with reference to embodiments thereof as illustrated in the accompanying drawings, in which like reference numerals are used to indicate identical or functionally similar elements. References to "one embodiment", "an embodiment", "an example embodiment", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

The following examples are illustrative, but not limiting, of the present invention. Other suitable modifications and adaptations of the variety of conditions and parameters normally encountered in the field, and which would be apparent to those skilled in the art, are within the spirit and scope of the invention.

Embodiments of the present invention include a garment 10 that may be worn by a wearer while engaging in physical activities, such as activities like walking, running, and jumping that may occur in the ordinary course a person's daily routine or during athletic activities. The garment 10 may be configured to cause increased activity in a muscle in the wearer's body during a locomotion movement and/or when the wearer is stationary. Increased muscular activity may beneficially result in increased calorie consumption and toning of the activated muscles. In one embodiment, the garment 10 may activate or support a muscle in one or more posture related muscle groups, which may lead to improved posture and balance. In another embodiment, garment 10 may constrain a wearer's movement or stance to help correct posture and/or balance. In some embodiments, garment 10 can provide feedback—for example, tactile and/or proprioceptive feedback—to the wearer such that the wearer can correct posture and/or balance.

Figure 2:
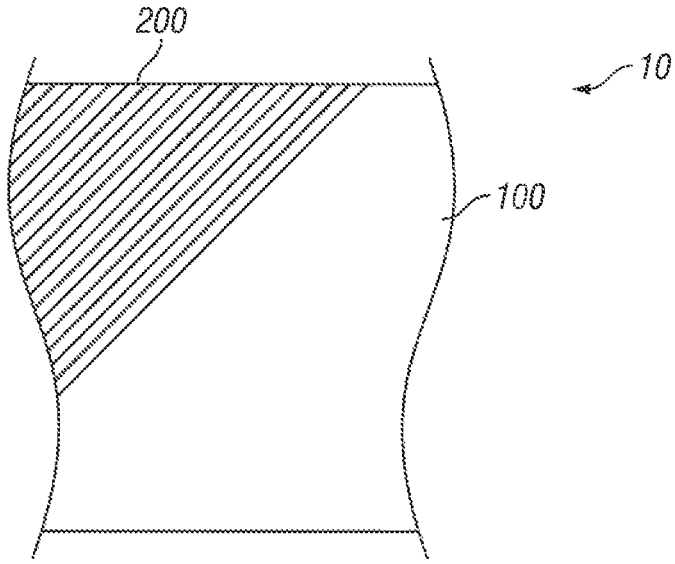
FIG. 2 is a schematic representation of a portion of a garment according to an embodiment of the present invention.
Figure 3:
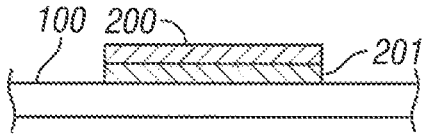
FIG. 3 is a schematic representation of a flexible layer on a base layer according to an embodiment of the present invention.

With reference to FIGS. 1-3, the garment 10 includes a base layer 100 and a flexible layer 200 disposed on the base layer 100. In one embodiment, as shown, for example, in FIG. 1, the flexible layer 200 may be disposed directly on the base layer 100. Alternatively, the flexible layer 200 may be adhered to the base layer 100 with adhesive 201 or other attachment means, as shown, for example, in FIG. 3. The flexible layer 200 may be attached to the base layer 100 by stitching, by an application of heat and/or pressure, or by other suitable method.

The base layer 100 may be configured as any suitable garment for physical activity. In one embodiment, base layer 100 may comprise a shirt. The shirt may be, for example, short-sleeved, long-sleeved, or sleeveless. In other embodiments, the base layer 100 may comprise pants, shorts, a lower or upper body undergarment, a jacket, a lower or upper body outergarment, a pullover, or other suitable garment or portions thereof. Moreover, the base layer 100 may be configured as a garment suitable for a particular activity, including, but not limited to, running, cross-training, hockey, football, soccer, baseball, skiing, lacrosse, basketball, track and field, or the like.

The base layer 100 may comprise one or more natural or synthetic materials, or combinations thereof. Suitable materials may include, for example, those made of cotton, flax, silk, polyester, aramid, acrylic, nylon, polyurethane, polyamide, spandex, and/or olefin. In one embodiment, the base layer 100 may include a blend of one or more materials. In some embodiments, base layer 100 contains at least one elastic fiber such as, e.g., spandex. For example, the base layer can contain at least about 10% elastic fiber or at least about 20% elastic fiber such as about 10 to about 30% elastic fiber or about 15 to about 25% elastic fiber. In some embodiments, base layer 100 is a blend of polyester and spandex such as, for example, a blend of about 80% polyester and about 20% spandex or a blend of polyamide and spandex such as, for example, a blend of about 79% polyamide and about 21% spandex. The materials making up the base layer 100 may, for example, be woven, knit, or composite textiles. In an embodiment, the base layer 100 may be fabricated as a single, unitary structure. In other embodiments, the base layer 100 may be fabricated by cutting and coupling various pieces of material together. Because the garments 10 of embodiments of the present invention may be capable of being assembled from one or more different materials, a variety of styles with a variety of desirable properties may be fabricated.

In one embodiment, the flexible layer 200 may comprise a flexible tape, such as, for example, a tape which includes polyurethane, nylon, polyester, polyolefin, and/or combinations thereof. Suitable flexible tapes include, but are not limited to, part nos. 3206, 3218, 3287,3405, 3410, 4220, 5214, 5250, 5290, 6218, ST644, ST646, ST647, TL100 OT100, 6343, 6344, 6371, and 6385 available from Bemis Associates, Inc. (Shirley, Mass.) and part nos. EXF-367 and UAF-442 available from Adhesive Films, Inc. (Pine Brook, N.J.). In another embodiment, the flexible layer 200 may comprise a silicon ink that may be printed directly onto the base layer 100. For example, a silicon ink suitable for use on textiles may be printed onto the base layer 100 with a sufficient thickness to provide the desired stretch and modulus to the garment 10. Examples of desired stretch and modulus are described infra. In still other embodiments, the flexible layer 200 may comprise one or more natural or synthetic materials or combinations thereof, including, but not limited to, cotton, silk, flax, polyester, aramid, acrylic, nylon, polyurethane, spandex, and/or olefin fibers. In some embodiments, it may be desirable to utilize a material for the flexible layer 200 that has a relatively high coefficient of friction compared to other materials.

In one embodiment, the flexible layer 200 may be coupled to the base layer 100 by stitching, by an adhesive, by an application of heat and/or pressure or other suitable method. In one embodiment, the flexible layer 200 may be integrally formed with the base layer 100, and may comprise one or more natural or synthetic materials, or combinations thereof, such as those made of cotton, flax, silk, polyester, aramid, acrylic, nylon, polyurethane, spandex, and/or olefin. In one embodiment, the base layer 100 and the flexible layer 200 have at least one material in common. In another embodiment, the base layer 100 and the flexible layer 200 do not have a material in common. In some embodiments, the particular materials used may be chosen for certain properties such as stretchability, breathability, ease of laundering, cost, etc. In one embodiment, the garment 10 may include flexible layers disposed on the base layer 100 using different techniques. For example, the garment 10 may include both printed and non-printed flexible layers 200.

Figure 5:
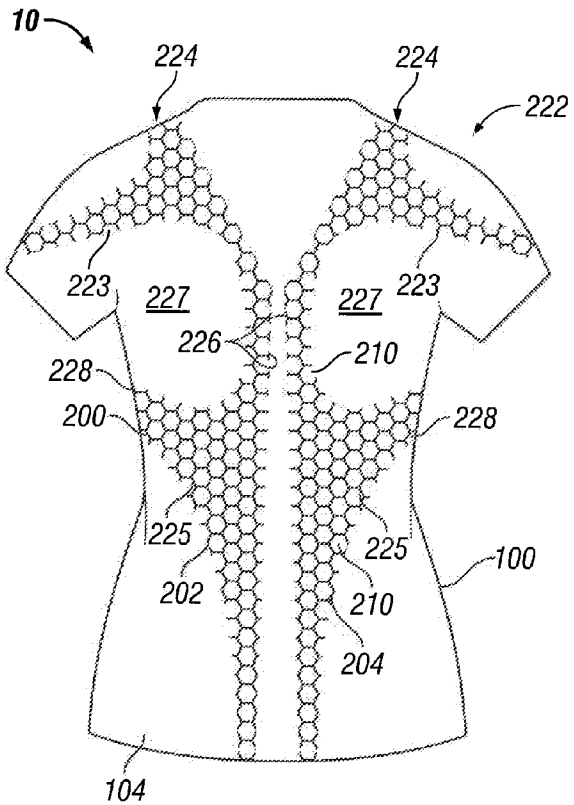
FIG. 5 is a rear view of the garment of FIG. 4 according to an embodiment of the present invention.
Figure 4:
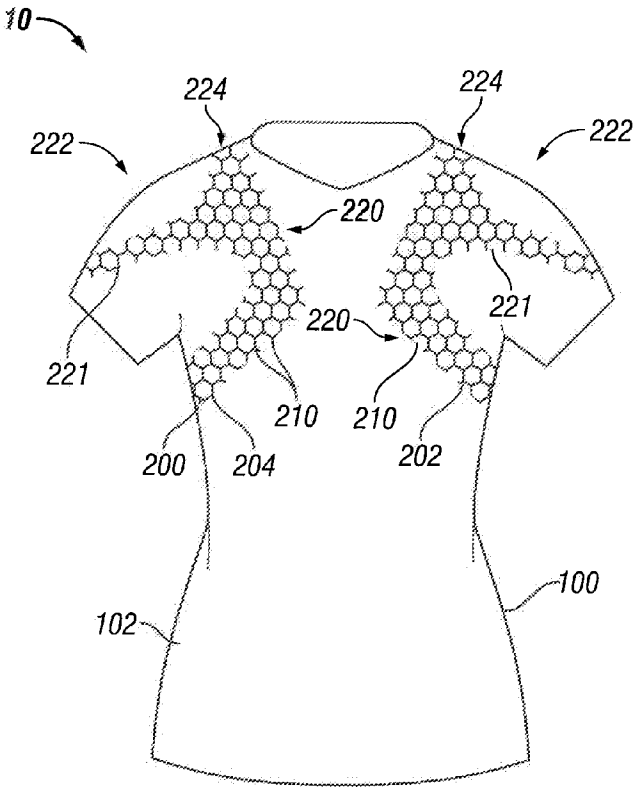
FIG. 4 is a front view of a garment according to an embodiment of the present invention.

As shown in FIGS. 4 and 5, the base layer 100 may comprise a shirt having a front surface 102 and a back surface 104. The flexible layer 200 may be disposed on a portion of the front surface 102 and a portion of the back surface 104 of the base layer 100.

In one embodiment, the garment 10 may include a plurality of flexible layers 200.

For example, the garment 10 may include a first flexible layer 202, generally disposed on the left side of the wearer's torso, and a second flexible layer 204, generally disposed on the right side of the wearer's torso. It will be appreciated that the positioning of the first and second flexible layers may be reversed or otherwise provided. For example, the first flexible layer 202 may be generally disposed on an upper portion of the wearer's body and the second flexible layer 204 may be generally disposed on a lower portion of the wearer's body. One or both of the first 202 and second 204 flexible layers may comprise continuous layers that are disposed on the front surface 102 and the back surface 104 of the base layer 100. For example, in embodiments where the flexible layer is printed on the base layer 100 it may form a continuous layer without a break. In other embodiments, the flexible layer 200 may comprise more than one portion such that it is non-continuous. One or both of the first 202 and second 204 flexible layers may also comprise unitary, continuous layers such that the layer is formed as a single piece. In other embodiments, one or both of the first 202 and second 204 flexible layers may comprise multiple discrete portions that are connected or attached so as to make a single piece.

The flexible layer 200 may be configured on the base layer 100 to support or cause increased activity in one or more muscles of the wearer. In one embodiment, the garment 10 may activate, support or otherwise affect a muscle in one or more posture related muscle groups, which may lead to improved posture and balance. For example, the garment 10 may activate muscle(s) in muscle groups including, but not limited to, the rhomboid, latissimus dorsi, deltoid, trapezius, and/or erector spinae groups.

In one embodiment, the base layer 100 and the flexible layer 200 may have different resistance to stretching. In an embodiment of the present invention, the base layer 100 may have a base level resistance to stretching, while the flexible layer 200 may have a resistance to stretching that is greater than the base level resistance to stretching. In alternate embodiments, the flexible layer 200 may have a resistance to stretching that is less than the base level resistance to stretching, or the flexible layer 200 resistance to stretching may be equal to the base level resistance to stretching.

The base layer 100 and flexible layer 200 may be selected to provide the desired balance of performance and comfort to the user. Two important parameters that may impact the performance and comfort of the garment 10 are the stretch and modulus of the garment or portions of the garment. In some embodiments if stretch is too low, performance can lag. If modulus is too high, comfort can be compromised.

As will be appreciated by those of ordinary skill in the art, in some embodiments, to determine the stretch of a material sample, the material sample may be hung with no load attached and a distance ($A_1$) is measured between two benchmarks on the material. A ten pound force is then applied to the bottom of the material sample and the distance ($D_1$) between the two benchmarks is measured. Stretch is measured as a percentage and is determined by the following formula:

$$\text{Stretch (\%)}=100\times[(D_1-A_1)/A_1].$$

For example, a completely non-stretchable material sample would have a 0% stretch.

In some embodiments, suitable stretch of portions of the garment 10 having both the base layer 100 and the flexible layer 200 can be at least about 10% such as about 10% to about 30%, about 15% to about 25%, or about 16% to about 20%.

As will be appreciated by those of ordinary skill in the art, modulus can be defined as tensile stress at 40% elongation, and can be measured using a 1 inch (2.54 cm) by 8 inch (20.32 cm) strip of material. In some embodiments, suitable modulus of portions of the garment 10 having both the base layer 100 and the flexible layer 200 may be no greater than about 4.8 pounds (lbs) (about 21.4 Newtons (N)), such as, for example, about 1.6 lbs (about 7.1 N) to about 4.8 lbs (about 21.4 N), about 2 lbs (about 8.9 N) to about 4 lbs (about 17.8 N), or about 2.4 lbs (about 10.7 N) to about 3 lbs (about 13.3 N).

In some embodiments, portions of the garment having both the base layer 100 and the flexible layer 200 have a stretch of at least about 10% and a modulus no greater than about 4.8 lbs (about 21.4 N), for example, a stretch of at least about 16% and a modulus no greater than about 3.0 lbs (about 13.3 N). In certain specific embodiments, portions of the garment 10 having both the base layer 100 and the flexible layer 200 have a stretch of about 10% to about 30% and a modulus of about 1.6 lbs (about 7.1 N) to about 4.8 lbs (about 21.4 N). In other embodiments, these garment portions have a stretch of about 15% to about 20% and a modulus of about 2.4 lbs (about 10.7 N) to about 3.0 lbs (about 13.3 N). Other stretch and modulus characteristics are considered to be within the scope of the present invention, and the base layer 100 and flexible layer 200 may be selected to provide the desired balance of performance and comfort to the user.

Figure 6:
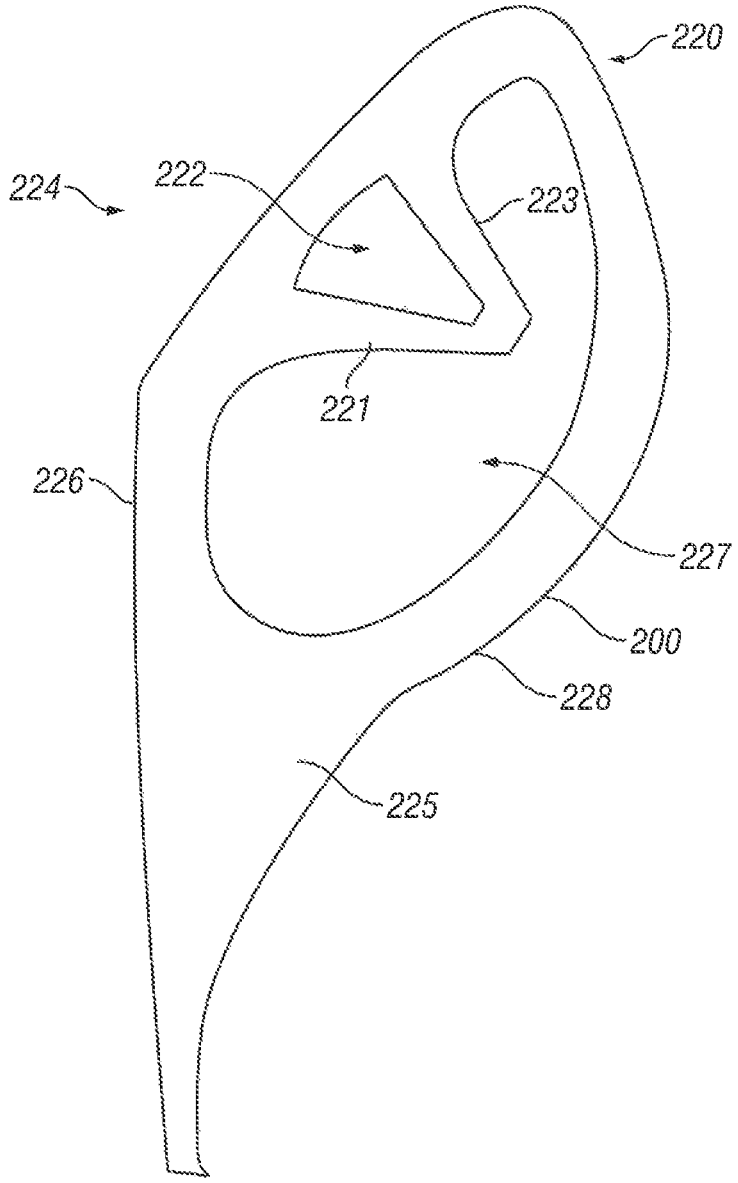
FIG. 6 is a schematic view of a flexible layer pattern according to an embodiment of the present invention.

With reference to FIGS. 4-6, an exemplary configuration of the flexible layer 200 is shown. The flexible layer 200 may include a generally C-shaped portion 220 that may extend along a portion of the front surface 102 of the base layer 100. In one embodiment, the C-shaped portion 220 may extend along a portion of the pectoral muscle group. In one embodiment, the flexible layer 200 may include an upper transition portion 224 that extends between the front surface 102 and the back surface 104 of the base layer 100. In one embodiment, the upper transition portion 224 may extend along a portion of the Trapezius muscle group and may extend continuously from the C-shaped portion 220. The flexible layer 200 may further include a first arm portion 221 on the front surface 102 and a second arm portion 223 on the back surface 104 that form an opening 222 in the flexible layer. In one embodiment, the first 221 and second 223 arm portions may extend along a portion of the deltoid muscle group, and the opening 222 may be disposed over a shoulder portion of the wearer.

The flexible layer 200 may further include a longitudinal portion 226 extending longitudinally on the back surface 104. The longitudinal portion 226 may extend continuously from the upper transition portion 224 and may extend along all or a portion of the longitudinal length of the base layer 100. In one embodiment, the longitudinal portion 226 may be disposed near the center of the back surface 104 and may extend along a portion of one or more of the rhomboid, latissimus dorsi, trapezius, and/or erector spinae groups. In one embodiment, one or both of the first 202 and second 204 flexible layers may be configured such that the longitudinal portion 226 does not extend across the center of the back surface 104, as shown, for example, in FIG. 5. In some embodiments, this may result in the flexible layer not being disposed directly over the spine of the wearer. In other embodiments, the first 202 and second 204 flexible layers may connect along the longitudinal portion 226 and thus extend across the center of the back surface 104.

The flexible layer 200 may further include a generally triangular shaped lower back portion 225, which may extend along a portion of the latissimus dorsi muscle group. In one embodiment, the flexible layer 200 may further include a lower transition portion 228 that extends between the front surface 102 and the back surface 104 of the base layer 100 below the upper transition portion 224. The lower transition portion 228 may extend continuously from the lower back portion 225 and the C-portion 220, and may extend along a portion of the latissimus dorsi muscle group. The longitudinal portion 226 and the lower transition portion 228 may form a large opening 227 in the flexible layer 200. The opening 227 may be generally disposed over the shoulder blade of the wearer.

Other configurations for the flexible layer 200 on the base layer 100 may be used to support or cause increased activity in one or more posture related muscle groups, which may lead to improved posture and balance.

In one embodiment, the garment 10 is configured to be able to cause increased activity in a muscle during a locomotion movement via an increase in the resistance to contraction of the muscle provided by the garment 10 during locomotion of the wearer. Increased muscular activity due to establishing resistance to muscle contraction may beneficially result in increased calorie consumption and toning of the activated muscles, and may lead to improved posture and balance.

In an embodiment of the present invention, the increase in the resistance to contraction of the muscle provided by the garment 10 may be due at least in part to the presence of the flexible layer 200. This may be the case in embodiments where the flexible layer 200 has a resistance to stretching greater than the base level resistance to stretching of the base layer 100.

When a portion of the garment 10 including the flexible layer 200 is stretched during a locomotion movement that is caused in part by a contraction of a muscle, the muscle may experience increased resistance to contraction as compared to situations where the garment 10 was absent, where the garment 10 did not contain the flexible layer 200, or where the flexible layer's resistance to stretching was lower. In response to this increased resistance, the muscle must work harder and increase its muscle activity to execute the locomotion movement.

In one embodiment, as shown in FIGS. 4 and 5, the flexible layer 200 may include a plurality of voids 210 formed therein such that the flexible layer comprises a lattice pattern 200. The lattice pattern may surround the plurality of voids 210. In one embodiment, as shown in FIGS. 4 and 5, the plurality of voids 210 may comprise hexagonal-shaped voids. In this manner, the voids may form a honeycomb pattern in the flexible layer. Because areas where the flexible layer is disposed on the base layer 100 may have more material, the voids 210 may provide for areas of increased breathability of the garment 10. One or more voids 210 may be substantially surrounded by the material of the flexible layer 200. In this manner, one or more of the voids 210 may also provide for isolated "dead zones" in which resistance provided by the flexible layer 200 may be reduced.

In one embodiment, during manufacturing the flexible layer 200 may first be provided without the voids 210, and the voids may subsequently be cut into the flexible layer. For example, the voids 210 may be cut with a die or laser.

Various characteristics including, but not limited to, the geometry of the pattern of the flexible layer 200, the size and shape of the voids 210, the degree of void symmetry, and the shape of the flexible layer 200 surrounding the void, may be selected to provide the desired stretch and/or modulus to the garment 10. Further, in some embodiments, these characteristics may be selected to provide the desired stretch and/or modulus to the garment 10 in particular directions of movement. For example, when stretched in different directions, a latticed portion of the flexible layer 200 having a circle shaped void 210 might have similar stretch and modulus in all directions, depending also upon the shape of the flexible layer that surrounds the void. In other embodiments, shapes such as triangle, squares, and hexagons might have different stretch and modulus in various directions. In some embodiments, the flexible layer 200 can be aligned to give a desired stretch and modulus in a given movement direction (e.g., along a muscle or in a direction to oppose muscle movement). In other embodiments, the flexible layer is constructed to give a variety of stretch and modulus in a variety of garment movement directions. The variety of stretch and modulus characteristics may be planned such that the user is aware of the affected movement directions. In some embodiments, the variety of stretch and modulus characteristics may be random.

Figure 7:
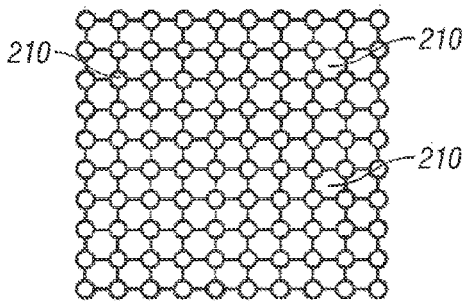
FIG. 7 is an isolated view of a flexible layer lattice pattern according to an embodiment of the present invention.
Figure 8A:
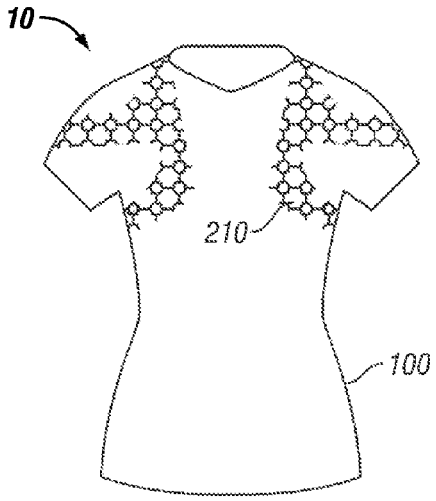
FIG. 8A is a front a garment having the flexible layer pattern shown in FIG. 7 according to an embodiment of the present invention.
Figure 8B:
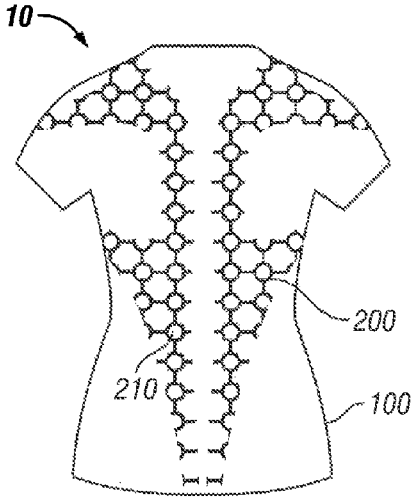
FIG. 8B is a rear view of the garment of FIG. 8A according to an embodiment of the present invention.

Other flexible layer configurations and void shapes, sizes, and patterns may be used. The voids 210 may be shaped, sized, and/or arranged to provide the desired flexibility of the flexible layer 200, and, thus, the desired muscle activity response. In one embodiment, as shown in FIGS. 7-8B, the flexible layer 200 may include voids 210 having different shapes and sizes. The flexible layer may include circular voids 210 and octagonal shaped voids 210.

Figure 9:
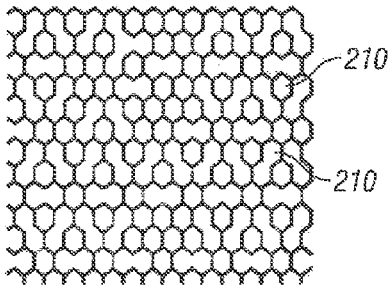
FIG. 9 is an isolated view of a flexible layer lattice pattern according to an embodiment of the present invention.
Figure 10A:
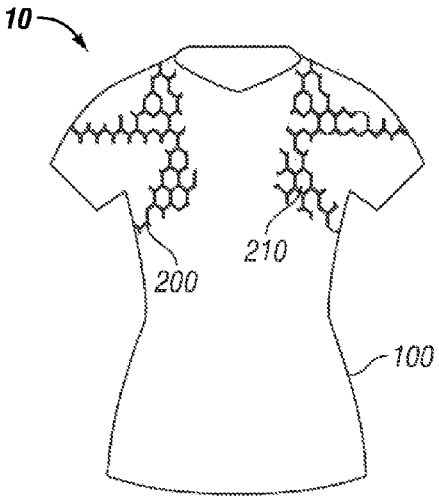
FIG. 10A is a front a garment having the flexible layer pattern shown in FIG. 9 according to an embodiment of the present invention.
Figure 10B:
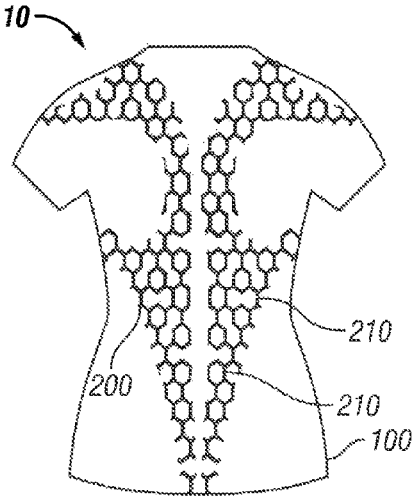
FIG. 10B is a rear view of the garment of FIG. 10A according to an embodiment of the present invention.
Figure 11:
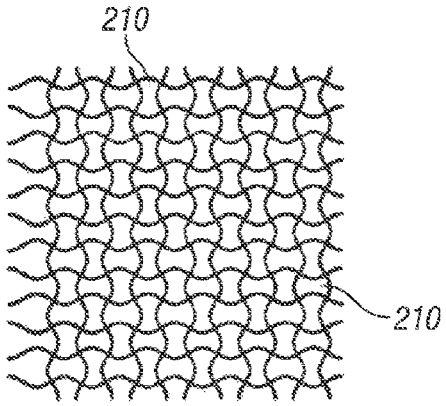
FIG. 11 is an isolated view of a flexible layer lattice pattern according to an embodiment of the present invention.
Figure 12A:
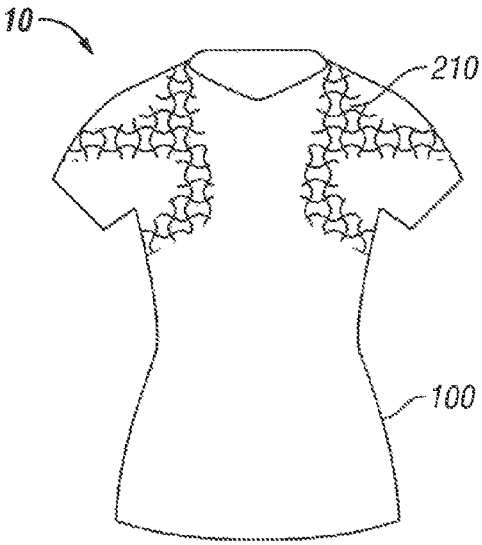
FIG. 12A is a front a garment having the flexible layer pattern shown in FIG. 11 according to an embodiment of the present invention.
Figure 12B:
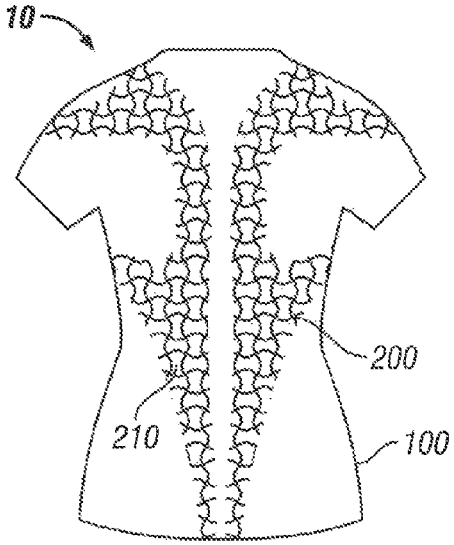
FIG. 12B is a rear view of the garment of FIG. 12A according to an embodiment of the present invention.

In one embodiment, as shown in FIGS. 9-10B, the flexible layer 200 may include elongated hexagonal shapes. The flexible layer 200 may further include voids 210 that comprise two voids combined.

Figure 13A:
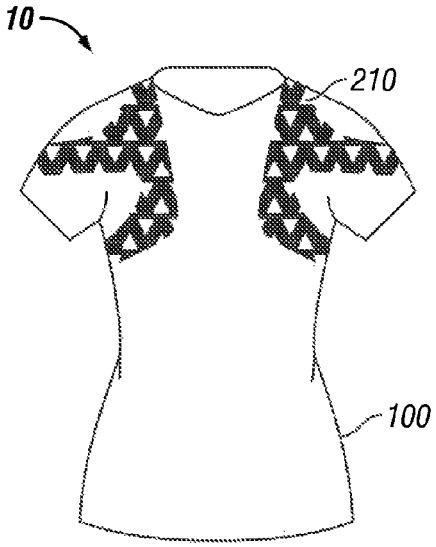
FIG. 13A is a front view of a garment according to an embodiment of the present invention.
Figure 13B:
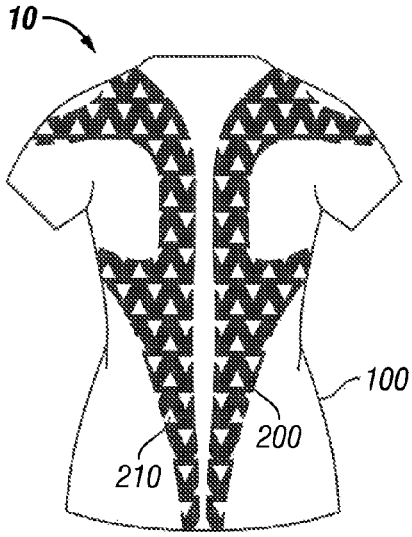
FIG. 13B is a rear view of the garment of FIG. 13A according to an embodiment of the present invention.

In one embodiment, as shown in FIGS. 13A and 13B, the flexible layer 200 may include triangular shaped voids 210.

Figure 14A:
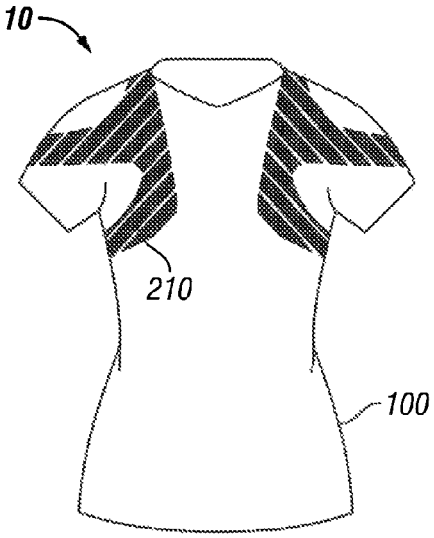
FIG. 14A is a front view of a garment according to an embodiment of the present invention.
Figure 14B:
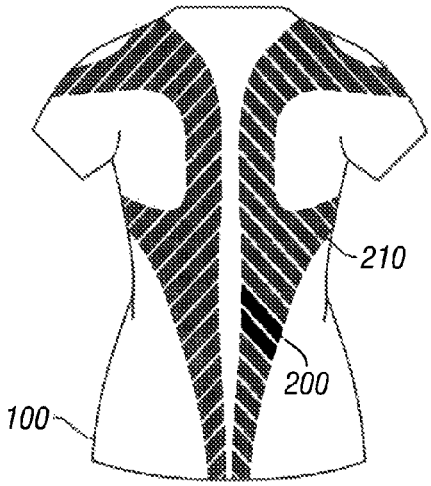
FIG. 14B is a rear view of the garment of FIG. 14A according to an embodiment of the present invention.

In one embodiment, as shown in FIGS. 14A and 14B, the flexible layer 200 may include slanted linear voids 210 such that the flexible layer includes a slanted striped pattern. The linear voids 210 may be of uniform width and may be of the same width as the flexible layer material adjacent to the void.

Figure 15A:
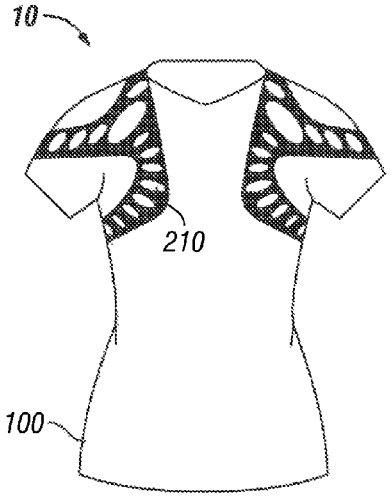
FIG. 15A is a front view of a garment according to an embodiment of the present invention.
Figure 15B:
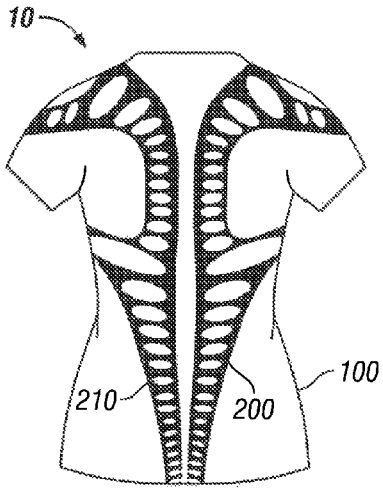
FIG. 15B is a rear view of the garment of FIG. 15A according to an embodiment of the present invention.

In one embodiment, as shown in FIGS. 15A and 15B, the flexible layer 200 may include oval shaped voids 210. The voids 210 may have uniform or different sizes throughout the flexible layer 200.

Figure 16A:
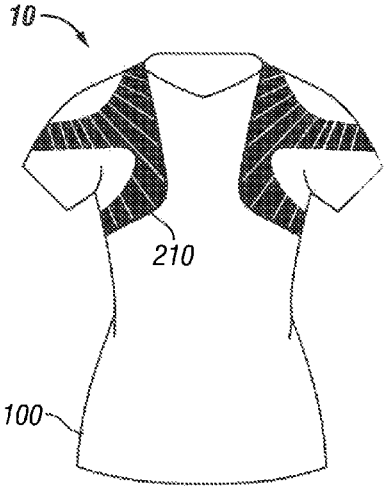
FIG. 16A is a front view of a garment according to an embodiment of the present invention.
Figure 16B:
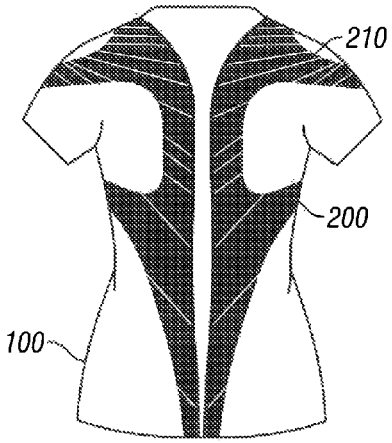
FIG. 16B is a rear view of the garment of FIG. 16A according to an embodiment of the present invention.

In one embodiment, as shown in FIGS. 16A and 16B, the flexible layer 200 may include slanted linear voids 210 such that the flexible layer includes a striped pattern that appears to radiate from a fixed point. The liner voids 210 may be of uniform width and may be of a narrower width than the flexible layer material adjacent to the void.

Figure 17A:
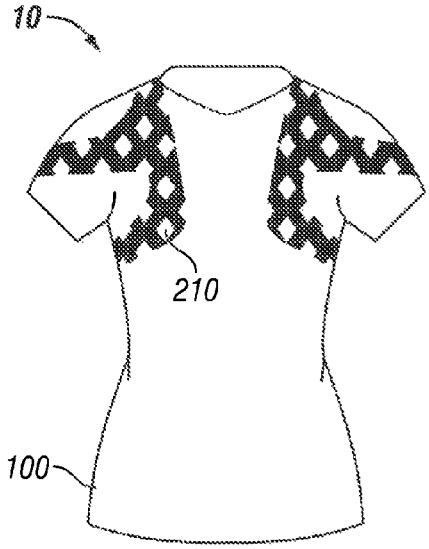
FIG. 17A is a front view of a garment according to an embodiment of the present invention.
Figure 17B:
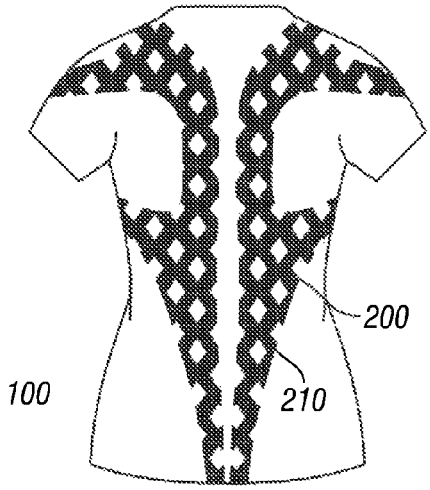
FIG. 17B is a rear view of the garment of FIG. 17A according to an embodiment of the present invention.

In one embodiment, as shown in FIGS. 17A and 17B, the flexible layer 200 may include diamond shaped voids 210.

Figure 18A:
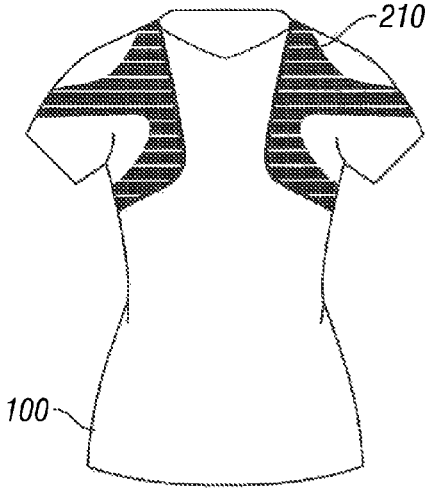
FIG. 18A is a front view of a garment according to an embodiment of the present invention.
Figure 18B:
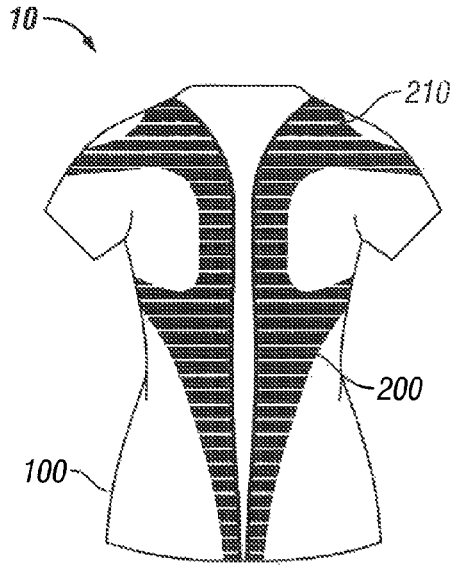
FIG. 18B is a rear view of the garment of FIG. 18A according to an embodiment of the present invention.

In one embodiment, as shown in FIGS. 18A and 18B, the flexible layer 200 may include horizontal linear voids 210 such that the flexible layer includes a horizontal striped pattern. The linear voids 210 may be of uniform width and may be of the same width as the flexible layer material adjacent to the void. The flexible layer 200 may also include vertical linear voids 210.

Figure 19A:
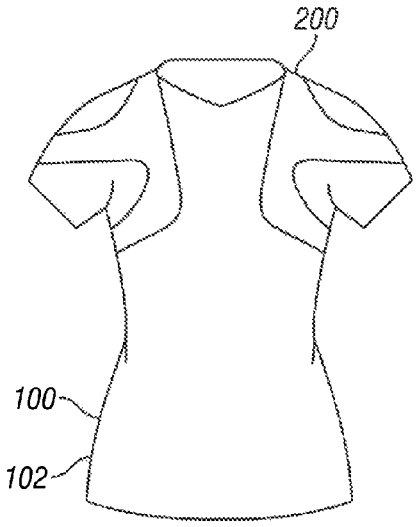
FIG. 19A is a front view of a garment according to an embodiment of the present invention.
Figure 19B:
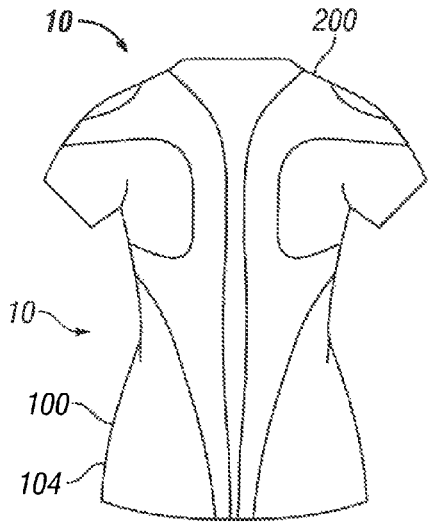
FIG. 19B is a rear view of the garment of FIG. 19A according to an embodiment of the present invention.
Figure 20:
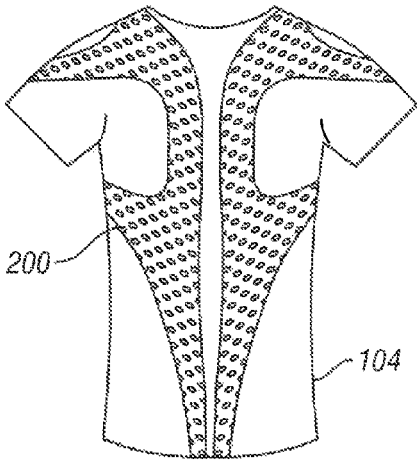
FIG. 20 is a rear view of a garment according to an embodiment of the present invention.
Figure 21:
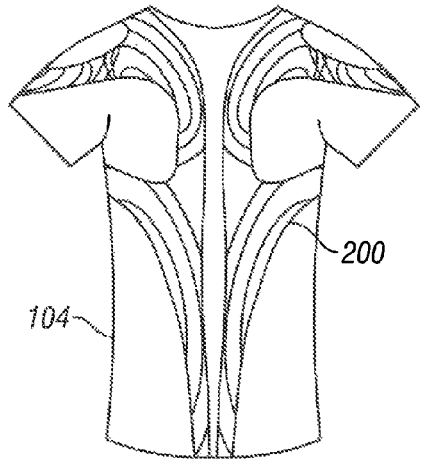
FIG. 21 is a rear view of a garment according to an embodiment of the present invention.

In one embodiment, as shown in FIGS. 19A and 19B, the flexible layer 200 may be a solid pattern that does not include voids 210. In one embodiment, as shown, for example, in FIGS. 20 and 21, the flexible layer 200 may be solid without voids 210 and may include a pattern printed or otherwise formed on the flexible layer. The pattern may also include flexible material that may provide a resistance level that is more, less, or the same as the flexible layer 200 itself.

Figure 22:
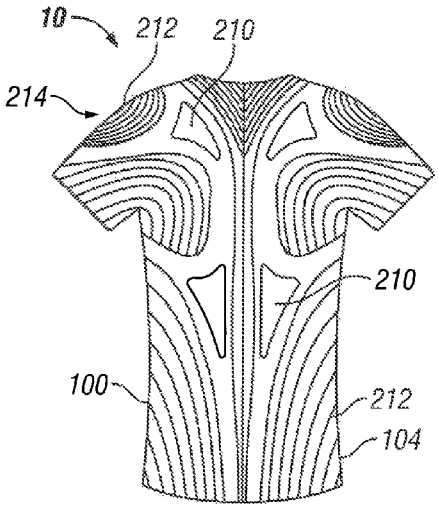
FIG. 22 is a rear view of a garment according to an embodiment of the present invention.
Figure 23A:
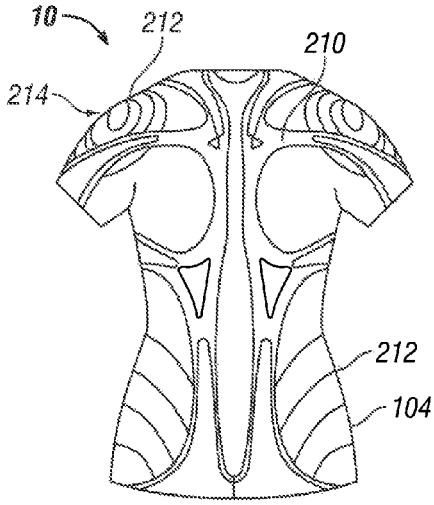
FIG. 23A is a rear view of a garment according to an embodiment of the present invention.
Figure 23B:
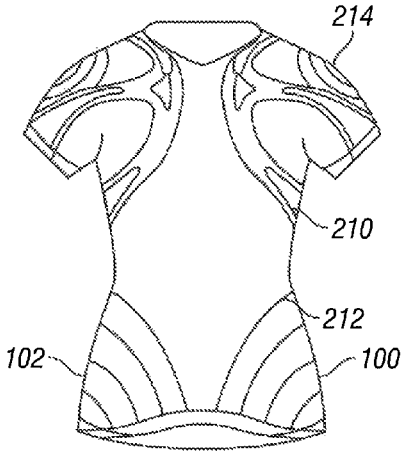
FIG. 23B is a front view of the garment of FIG. 23A according to an embodiment of the present invention.
Figure 24:
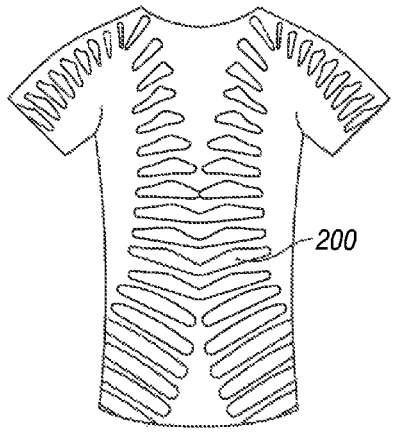
FIG. 24 is a rear view of a garment according to an embodiment of the present invention.
Figure 25:
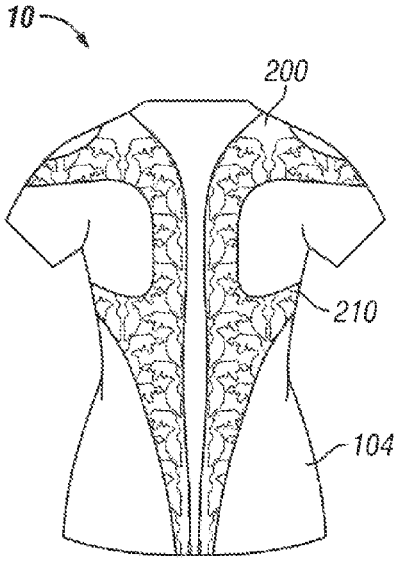
FIG. 25 is a rear view of a garment according to an embodiment of the present invention.
Figure 26:
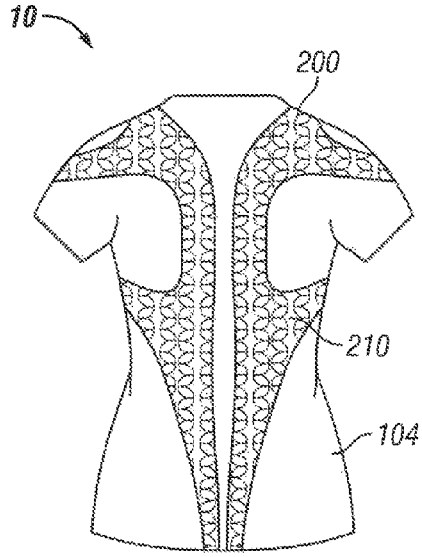
FIG. 26 is a rear view of a garment according to an embodiment of the present invention.
Figure 27:
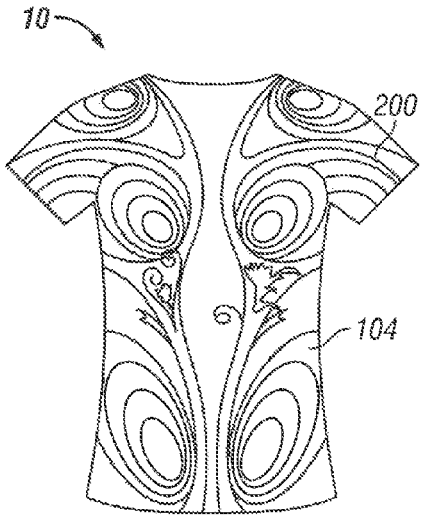
FIG. 27 is a rear view of a garment according to an embodiment of the present invention.
Figure 28:
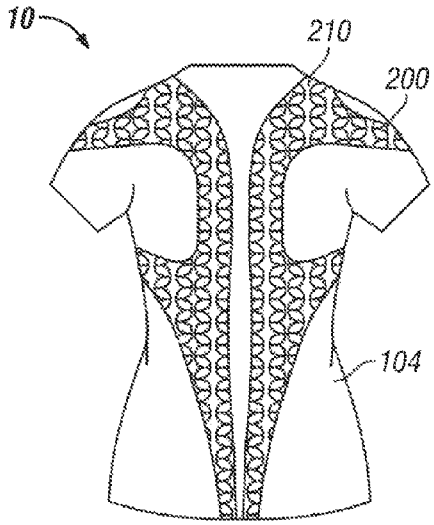
FIG. 28 is a rear view of a garment according to an embodiment of the present invention.
Figure 29:
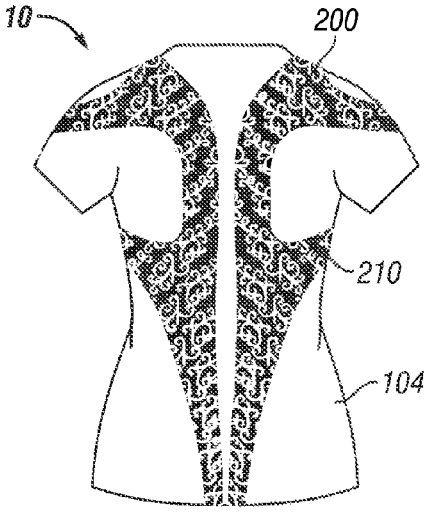
FIG. 29 is a rear view of a garment according to an embodiment of the present invention.
Figure 30:
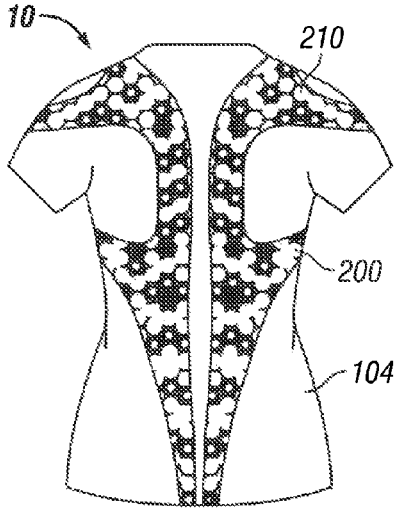
FIG. 30 is a rear view of a garment according to an embodiment of the present invention.
Figure 31A:
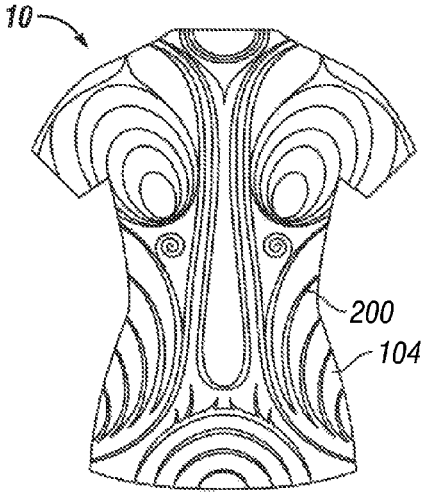
FIG. 31A is a rear view of a garment according to an embodiment of the present invention.
Figure 31B:
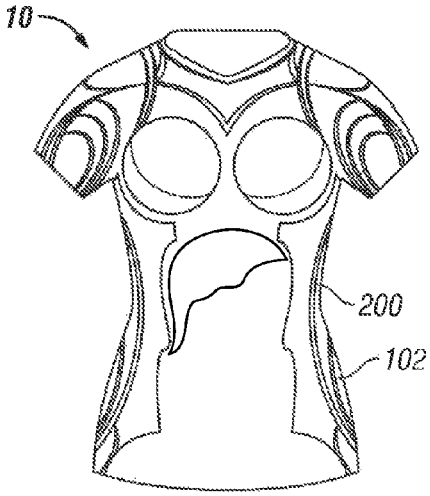
FIG. 31B is a front view of the garment of FIG. 31A according to an embodiment of the present invention.
Figure 32:
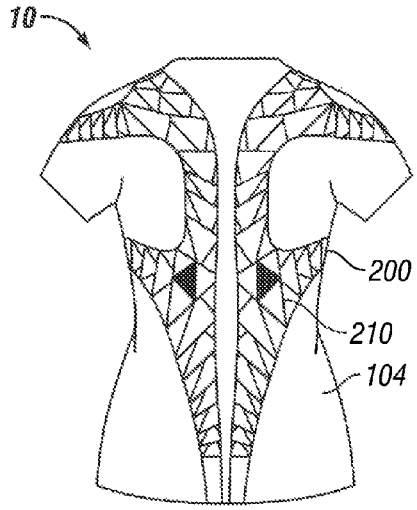
FIG. 32 is a rear view of a garment according to an embodiment of the present invention.
Figure 33:
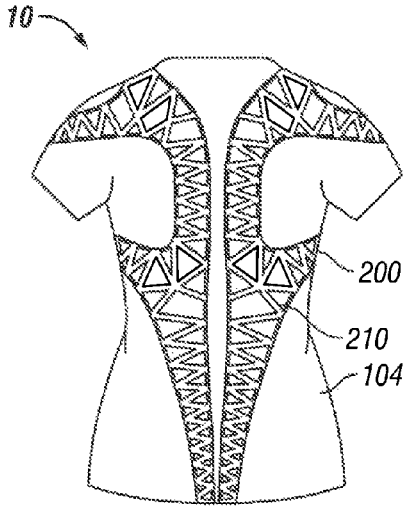
FIG. 33 is a rear view of a garment according to an embodiment of the present invention.
Figure 34:
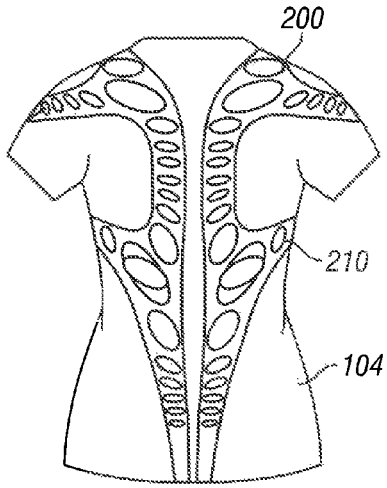
FIG. 34 is a rear view of a garment according to an embodiment of the present invention.
Figure 35:
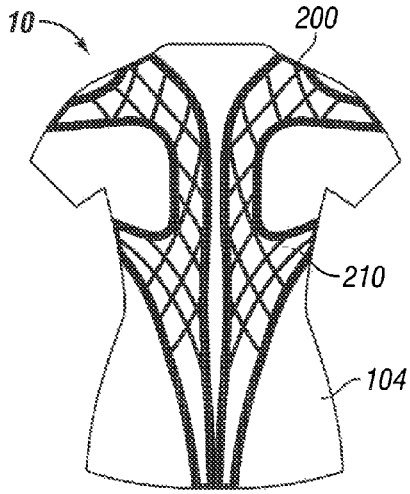
FIG. 35 is a rear view of a garment according to an embodiment of the present invention.

In one embodiment, as shown, for example, in FIGS. 22-23B, may include one or more flexible elements 212 in addition to, or in place of, the flexible layer 200. The flexible elements 212 may be made of the same or similar materials as the flexible layer 200 and may be disposed on the base layer 100 in the same or similar manner as the flexible layer 200, as described above. The flexible elements 212 may be linear, curved, circular, or otherwise shaped to achieve the desired results. In one embodiment, a plurality of flexible elements 212 may form a concentric circular pattern 214. In one embodiment, the concentric circular pattern 214 may be disposed on the deltoid muscle group, as shown, for example, in FIGS. 22 and 23A. Other configurations for the flexible elements 212 on the base layer 100 may be used to cause increased activity in one or muscle groups. In one embodiments, elements 212 may be primarily graphical in nature, In one embodiment, as shown, for example, in FIG. 24, the flexible layer 200 may comprise a plurality of individual elements that may form a skeletal pattern.

With reference to FIGS. 25-35, for example, the flexible layer 200 may include complex pattern that may be suitable for printing of the flexible layer 200 on the base layer 100. The complex patterns may include a series of small or intricate voids 210, as shown, for example, in FIGS. 29 and 30, and/or intricate designs, as shown, for example, in FIGS. 31A and 31B. Because of the complexity of the designs, the flexible layer 200 may be more efficiently printed onto the base layer 100 rather than by, for example, cutting and applying the flexible layer. The flexible layers shown in FIGS. 25-35 as suitable for printing are meant to be illustrative only and not limiting. Other flexible layer 200 patterns shown may be disposed on the base layer 100 with a printing method. Further, the flexible layers shown in FIGS. 25-35 may be disposed on the base layer 100 using other techniques described herein.

Figure 36A:
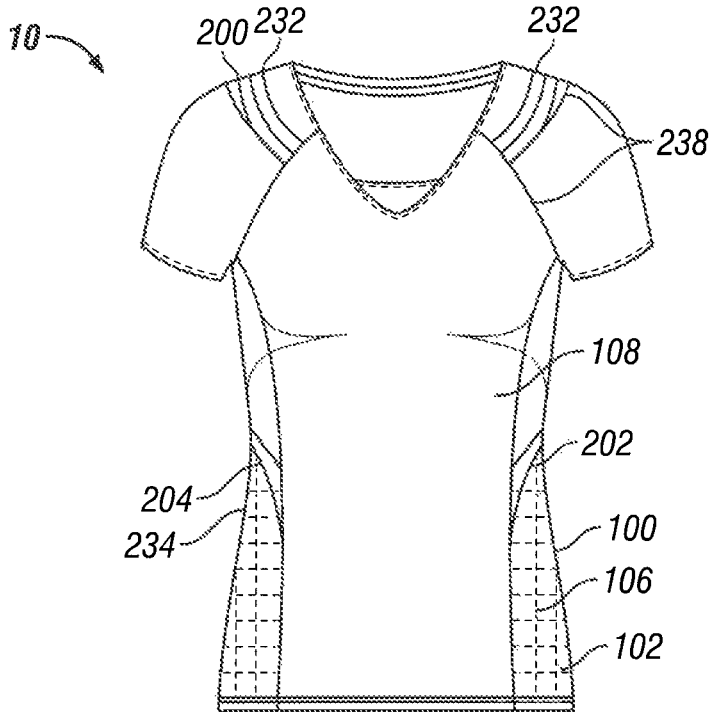
FIG. 36A is a front view of a garment according to an embodiment of the present invention.
Figure 36B:
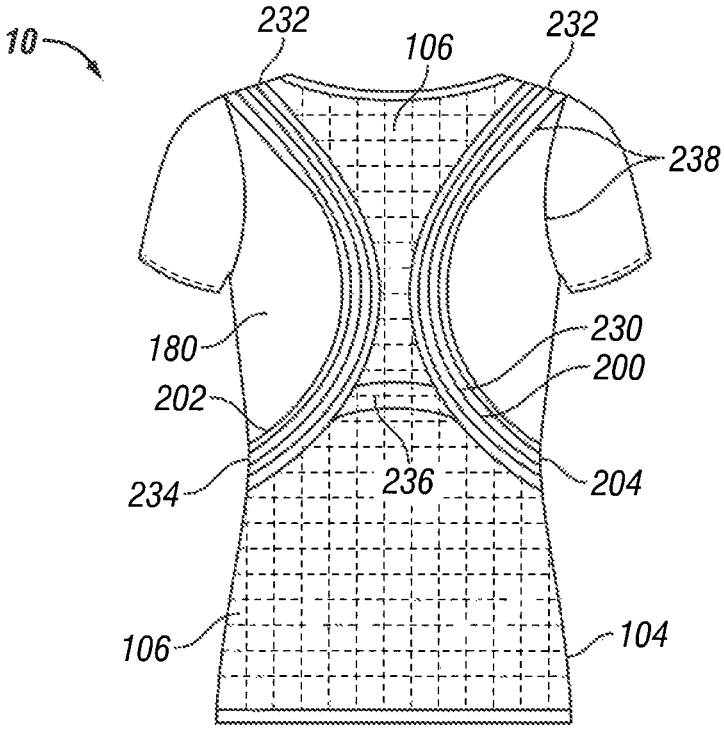
FIG. 36B is a rear view of the garment of FIG. 36A according to an embodiment of the present invention.
Figure 36C:
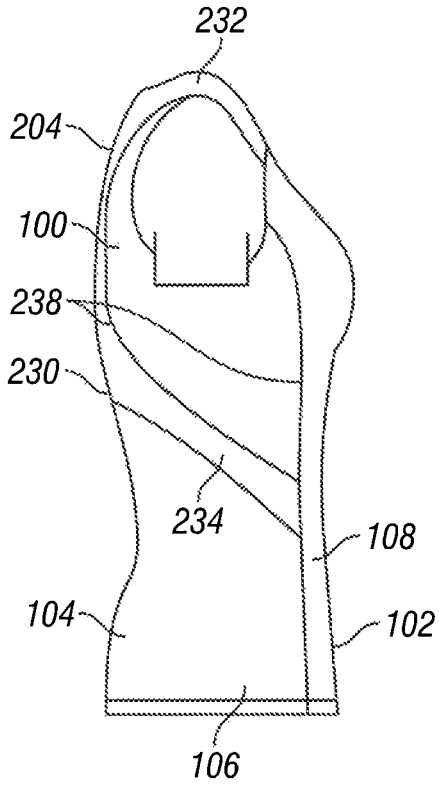
FIG. 36C is a side view of the garment of FIG. 36A according to an embodiment of the present invention.

In one embodiment, as shown in FIGS. 36A-C, the garment 10 includes a base layer 100 that may comprise a shirt having a front surface 102 and a back surface 104, and a flexible layer 200 disposed on the base layer 100. In one embodiment, first 202 and second 204 flexible layers may be disposed on a portion of the front surface 102 and a portion of the back surface 104 of the base layer 100. One or both of the flexible layers 200 may include a generally C-shaped portion 230 disposed on a portion of the back surface 104 of the base layer 100 and the front surface 102. In one embodiment, the C-shaped portion 230 may curve inwardly from the outer edge of the back surface 104 toward the center of the back, and may extend along a portion of one or more of the rhomboid, latissimus dorsi, trapezius, and/or erector spinae muscle groups. The C-shaped portion 230 may further include an upper transition portion 232 that extends between the front surface 102 and the back surface 104 of the base layer 100. In one embodiment, the upper transition portion 232 may extend along a portion of the wearer's trapezius muscle group. The C-shaped portion 230 may further include a lower transition portion 234 that extends between the front surface 102 and the back surface 104 of the base layer 100. The lower transition portion 234 may extend along a portion of the wearer's latissimus dorsi muscle group. A center bridge portion 236 may extend across the center of the back surface 104 and connect the first 202 and second 204 flexible layers.

In one embodiment, the garment 10 may further include flexible elements 238 disposed on the base layer 100. The flexible elements 238 may be made of the same or similar materials as the flexible layer 200 and may be disposed on the base layer 100 in the same or similar manner as the flexible layer 200, as described above. The flexible elements 238 may be linear, curved, circular, or otherwise shaped to achieve the desired results. In one embodiment, the flexible elements 238 may border all or a portion of the flexible layer 200. In one embodiment, the flexible elements 238 may separate adjacent portions of the base layer 100 made of different materials. For example, as best shown in FIG. 36C, the flexible elements 238 may separate a first portion 106 of the base layer 100 made of a first material and a second portion 108 of the base layer 100 made of a second material. The flexible layer 200, the flexible elements 238, and/or adjacent portions of the base layer 100 may combine to support or to cause increased activity in a muscle in the wearer's body during a locomotion movement and/or when the wearer is stationary. In one embodiment, the garment 10 may activate a muscle in one or more posture related muscle groups, which may lead to improved posture and balance. In one embodiment, the elements 238 may comprise flexible tape disposed over seams between the first portion 106 and the second portion 108 of the base layer.

Figure 37A:
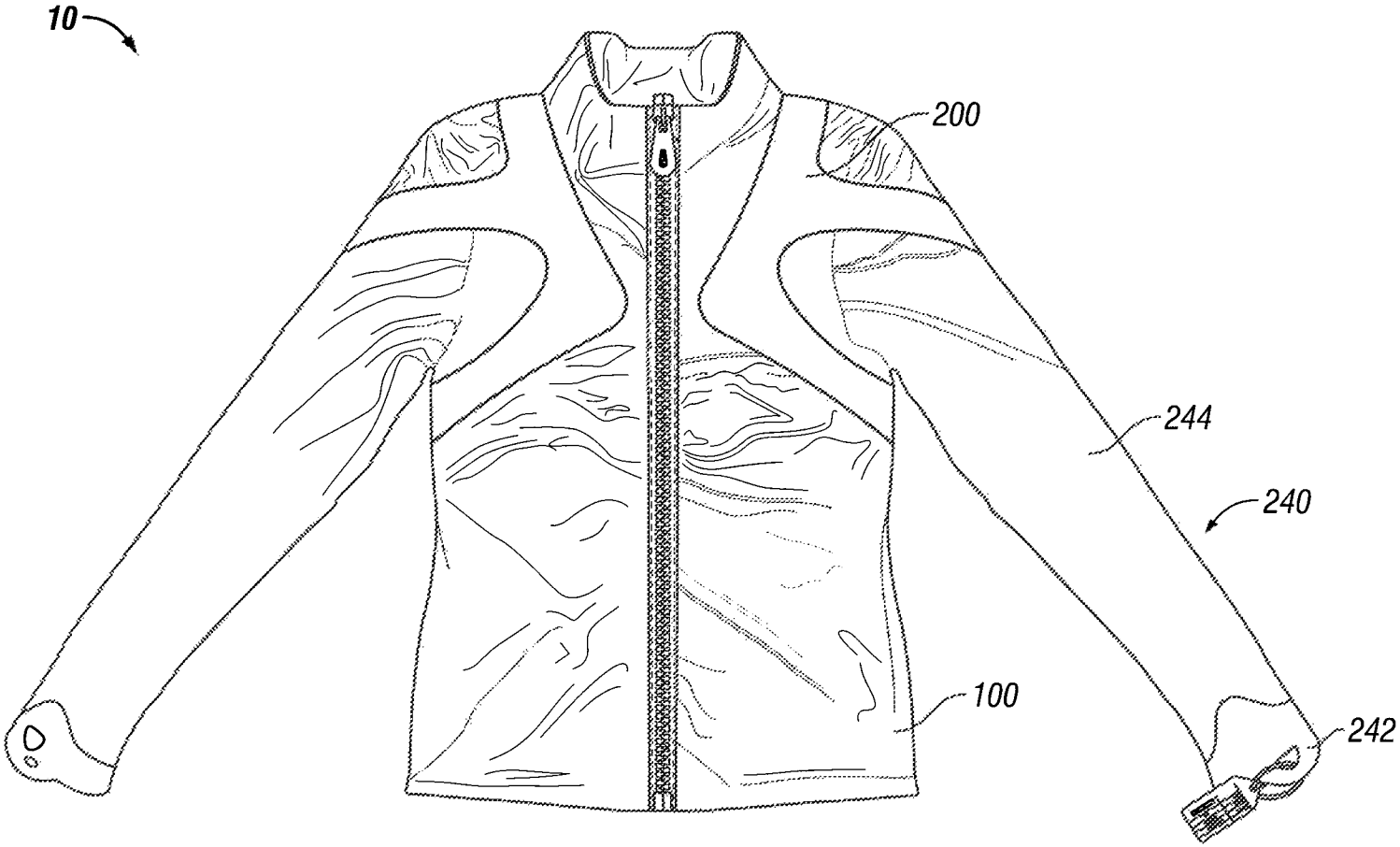
FIG. 37A is a front view of a garment according to an embodiment of the present invention.
Figure 37B:
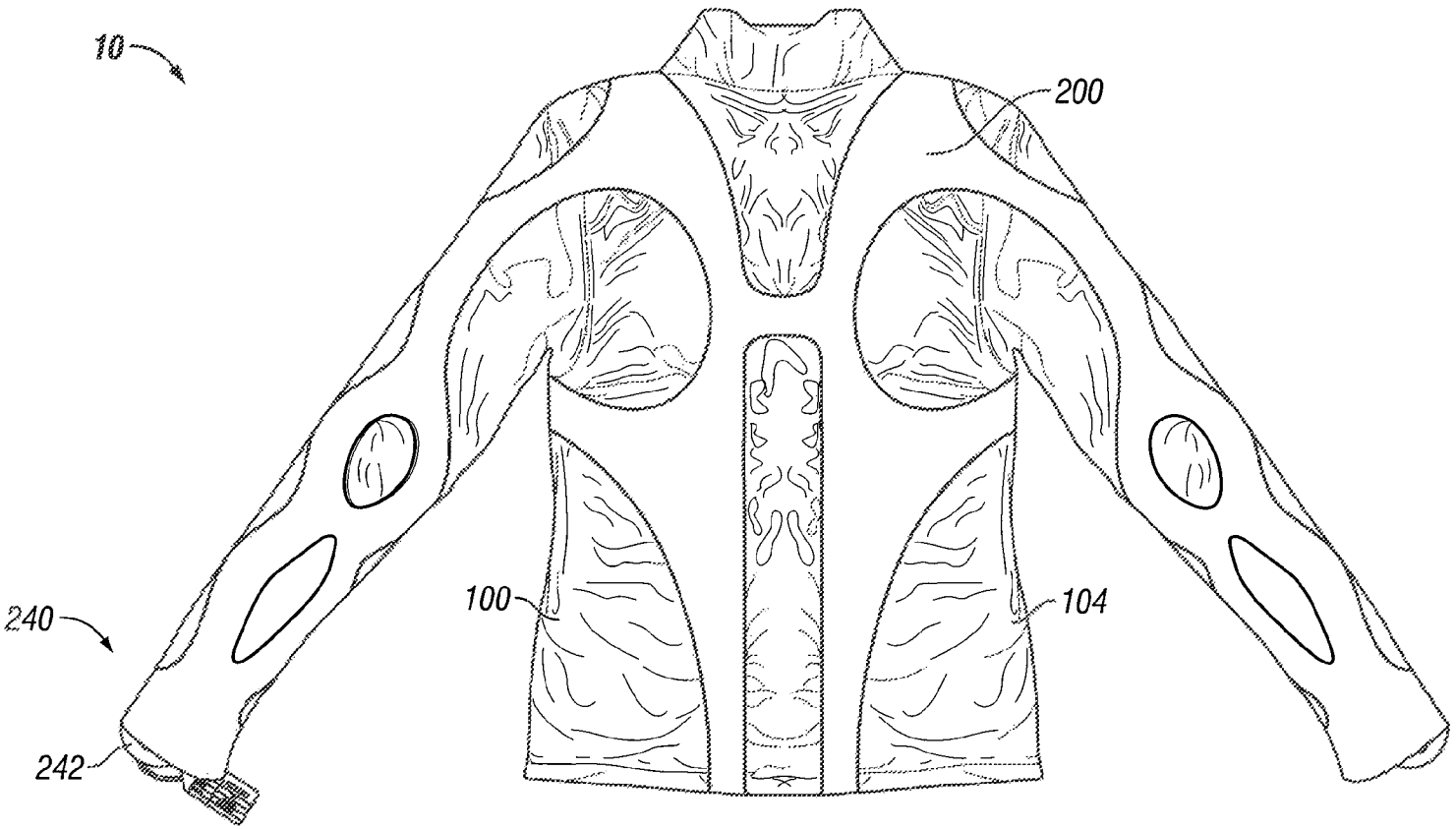
FIG. 37B is a rear view of a garment according to an embodiment of the present invention.

In one embodiment of the present invention, the garment 10 may include activation means 240 for activating and deactivating the muscle activity causing effect of all or a portion of the flexible layer 200. In one embodiment, as shown in FIGS. 37A and B, the base layer 100 may be configured as a jacket. The activation means 240 may include a loop 242 adapted to receive a portion of the wearer's body, such as, for example, a thumb. The loop 242 may be integrally formed with the base layer 100 and may be operatively connected to all or a portion of the flexible layer 200. The flexible layer 200 may include, for example, an arm portion 244 that extends along the arm portion of the base layer 100 so as to be operatively connected to the loop 242. When the activation means 240 is activated and the loop 242 is disposed about the wearer's thumb, the arm portion 244 is pulled into tension, thereby causing increased resistance against one or more muscles of the wearer. This, in turn, may lead to increased muscle activity in this area.

Figure 38:
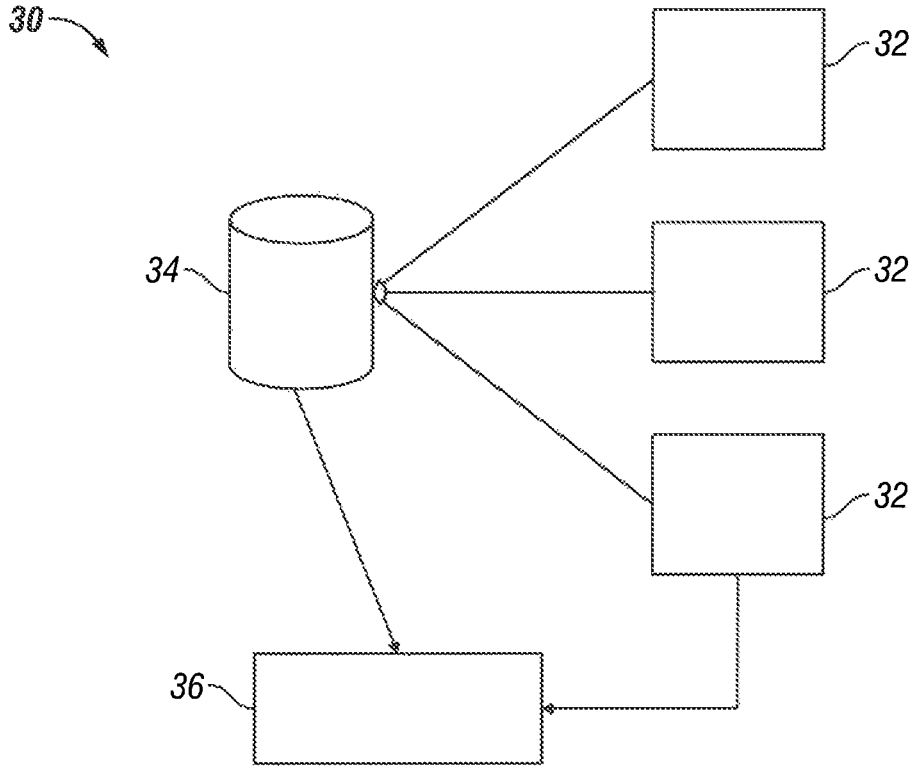
FIG. 38 is a schematic diagram of a customized printing system according to an embodiment of the present invention.
Figure 39:
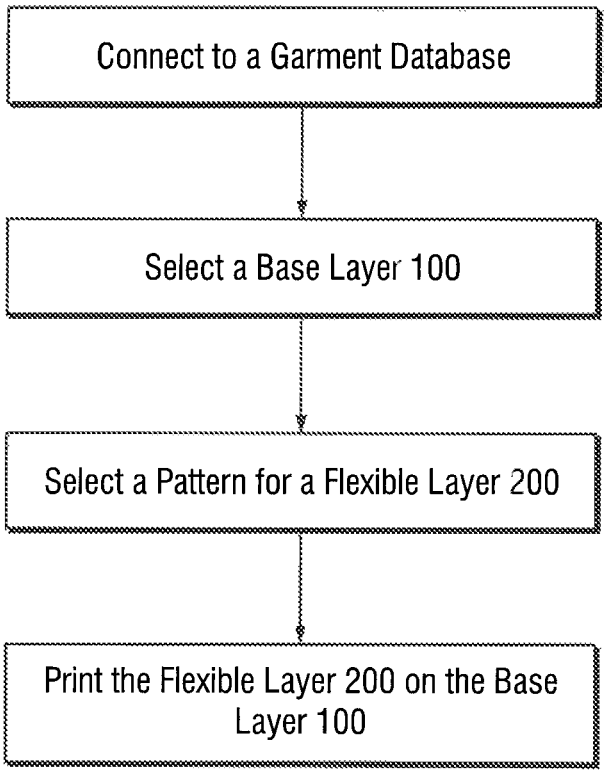
FIG. 39 is a flow diagram for a customized printing method according to an embodiment of the present invention.

In another aspect of the present invention, embodiments may include a method of providing a customized fitness garment 10. With reference to FIGS. 38 and 39, a customized printing system 30 may be used to create customized fitness garments. A user may access computer readable recording medium storing one or more computer readable programs to execute the customized printing method. For example, a user may connect to a customized fitness garment database 34 over a network using one or more computers 32. As will be appreciated by those of skill in the art, the computer 32 may comprise a desktop computer, a portable computer, a mobile device, a phone or other suitable means, and may connect to the database 34 wirelessly or through a wired connection. The database 34 may store selections for a base layer 100 and a flexible layer 200. For example, the user may select a size, color, configuration, material and other desirable features for the base layer 100, and a configuration, pattern, material, and other desirable features for the flexible layer 200. The customized selection for the base layer 100 and flexible layer 200 may then be sent to a printing assembly 36, at which point the selected flexible layer 200 may be printed on the selected base layer 100.

The foregoing description of the specific embodiments will so fully reveal the general nature of the invention that others can, by applying knowledge within the skill of the art, readily modify and/or adapt for various applications such specific embodiments, without undue experimentation, without departing from the general concept of the present invention. Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

The breadth and scope of the present invention should not be limited by any of the above-described exemplary embodiments, but should be defined only in accordance with the following claims and their equivalents.

What is claimed is:

1. An athletic garment, comprising:

a base layer having a front surface and a back surface;

a first flexible layer disposed on the front surface and the back surface of said base layer, said first flexible layer having a plurality of voids forming a first lattice pattern; and a second flexible layer disposed on the front surface and the back surface of said base layer, said second flexible layer having a plurality of voids forming a second lattice pattern.

2. The athletic garment according to claim 1, wherein said first and second flexible layers comprise flexible tape adhered to said base layer.

3. The athletic garment according to claim 1, wherein said first flexible layer is connected to said second flexible layer on the back surface of said base layer.

4. The athletic garment according to claim 1, wherein said first and second flexible layers do not extend across the center along the length of the back surface of said base layer.

5. The athletic garment according to claim 1, wherein said first flexible layer comprises a continuous layer covering a portion of the front surface and a portion of the back surface.

6. The athletic garment according to claim 1, wherein said first flexible layer is printed on said base layer.

7. The athletic garment according to claim 6, wherein said flexible layer comprises silicon ink.

8. The athletic garment according to claim 1, wherein the first lattice pattern is uniform throughout said first layer.

9. The athletic garment according to claim 1, wherein the base layer is configured as a shirt.

10. The athletic garment according to claim 1, wherein the plurality of voids are die-cut.

11. The athletic garment according to claim 1, wherein at least one of the first and second lattice patterns is a hexagonal lattice.

12. The athletic garment according to claim 1, wherein at least one of the first and second flexible layers is elastic.

13. The athletic garment according to claim 1, wherein at least one of the first flexible layer disposed on the base layer or the second flexible layer disposed on the base layer has a stretch in the range of about 10% to about 30%.

14. The athletic garment according to claim 1, wherein at least one of the first flexible layer disposed on the base layer or the second flexible layer disposed on the base layer has a modulus of about 7.1 N to about 21.4 N at 40% elongation.

15. An athletic garment, comprising:

a base layer; and a continuous flexible layer disposed on a portion of said base layer, said flexible layer having a plurality of voids therein forming a honeycomb pattern, wherein said flexible layer is elastic.

16. The athletic garment according to claim 15, wherein said flexible layer comprises flexible tape.

17. The athletic garment according to claim 15, wherein said flexible ayer comprises silicon ink.

18. The athletic garment according to claim 15, wherein said flexible layer disposed on said base layer has a stretch in the range of about 10% to about 30%.

19. The athletic garment according to claim 15, wherein said flexible layer disposed on said base layer has a modulus of about 7.1 N to about 21.4 N at 40% elongation.

20. The athletic garment according to claim 15, wherein said base layer includes a front surface and a back surface, and said flexible layer comprises a continuous layer covering a portion of the front surface and a portion of the back surface.

21. The athletic garment according to claim 15, wherein said base layer is stretchable.

22. An athletic garment, comprising:

a base layer comprising a shirt having a front surface, a back surface, and first and second shoulder portions;

a continuous first flexible layer disposed on the front surface and the back surface of said base layer, said first flexible layer having upper and lower transition portions extending between the front surface and the back surface, said first flexible layer defining a void of said first flexible layer over the first shoulder portion of said base layer and having a plurality of smaller voids forming a pattern; and a continuous second flexible layer discrete from said first flexible layer disposed on the front surface and the back surface of said base layer, said second flexible layer having upper and lower transition portions extending between the front surface and the back surface, said second flexible layer defining a void of said second flexible layer over the second shoulder portion of said base layer and having a plurality of smaller voids forming a pattern.

23. The athletic garment according to claim 22, wherein said first and second flexible layers extend substantially along the length of the back surface.

24. The athletic garment according to claim 23, wherein said first and second flexible layers do not extend across a centerline along the length of the back surface of said base layer midway between the first and second shoulder portions.

25. The athletic garment according to claim 22, wherein said base layer comprises spandex.

26. The athletic garment according to claim 22, wherein said first flexible layer forms a lattice pattern.

27. The athletic garment according to claim 22, wherein the upper transition portion extends along a portion of the trapezius muscle group of the wearer and the lower transition portion extends along a portion of the latissimus dorsi muscle group of the wearer.

28. An athletic garment, comprising:

a base layer; and a continuous flexible and elastic layer having a plurality of voids forming a lattice pattern disposed on a portion of said base layer, wherein the portion of said base layer with said continuous flexible and elastic layer disposed thereon together have a stretch in the range of about 15% to about 20% and a modulus of about 10.7 N to about 13.3 N at 40% elongation.

29. An athletic garment, comprising:

a base layer haying a front surface and a back surface;

a first flexible layer disposed on the front surface and the back surface of said base layer, said first flexible layer having a plurality of voids forming a first lattice pattern; and a second flexible layer disposed on the front surface and the back surface of said base layer, said second flexible layer haying a plurality of voids forming a second lattice pattern, wherein said first flexible layer is printed on said base layer, and wherein said first flexible layer comprises silicon ink.

* * * * *

UNITED STATES PATENT AND TRADEMARK OFFICE

CERTIFICATE OF CORRECTION

PATENT NO. : 8,656,515 B2
APPLICATION NO. : 13/004551
DATED : February 25, 2014
INVENTOR(S) : Newton et al.

It is certified that error appears in the above-identified patent and that said Letters Patent is hereby corrected as shown below:

In the Claims:

In column 13, line 2 (claim 17), "flexible ayer comprises" is replaced with --flexible layer comprises--.

Signed and Sealed this
Second Day of September, 2014

Michelle K. Lee

Michelle K. Lee
*Deputy Director of the United States Patent and Trademark Office*